US008225863B2

(12) United States Patent
Hammer et al.

(10) Patent No.: US 8,225,863 B2
(45) Date of Patent: Jul. 24, 2012

(54) MULTI-ZONE SCREEN ISOLATION SYSTEM WITH SELECTIVE CONTROL

(75) Inventors: Aaron C. Hammer, Houston, TX (US); Nicholas J. Clem, Houston, TX (US); Edward J. O'Malley, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 312 days.

(21) Appl. No.: 12/533,151

(22) Filed: Jul. 31, 2009

(65) Prior Publication Data

US 2011/0024105 A1 Feb. 3, 2011

(51) Int. Cl.

| | |
|---|---|
| ***E03B 3/18*** | (2006.01) |
| ***E21B 43/08*** | (2006.01) |
| ***B01D 35/00*** | (2006.01) |

(52) U.S. Cl. ..... 166/235; 166/236; 166/373; 210/418; 210/459; 210/499

(58) Field of Classification Search ..... 166/373, 166/381, 205, 227, 235, 236; 210/459, 483, 210/485, 497.01, 499, 418, 420, 424, 85, 210/97

See application file for complete search history.

(56) References Cited

U.S. PATENT DOCUMENTS

| | | | | |
|---|---|---|---|---|
| 5,355,949 | A * | 10/1994 | Sparlin et al. | 166/236 |
| 5,609,204 | A | 3/1997 | Rebardi et al. | |
| 5,865,251 | A | 2/1999 | Rebardi et al. | |
| 5,921,318 | A | 7/1999 | Ross | |
| 6,343,651 | B1 | 2/2002 | Bixenman | |
| 6,405,800 | B1 | 6/2002 | Walker et al. | |
| 6,464,006 | B2 | 10/2002 | Womble | |
| 6,752,207 | B2 | 6/2004 | Danos et al. | |
| 7,048,061 | B2 | 5/2006 | Bode et al. | |
| 7,451,816 | B2 | 11/2008 | Corbett et al. | |
| 7,520,326 | B1 * | 4/2009 | Hill et al. | 166/278 |
| 2004/0262011 | A1 | 12/2004 | Huckabee et al. | |
| 2007/0119598 | A1 * | 5/2007 | Turner et al. | 166/386 |
| 2007/0246212 | A1 | 10/2007 | Richards | |
| 2008/0029273 | A1 * | 2/2008 | Pia | 166/373 |
| 2009/0095471 | A1 | 4/2009 | Guignard | |

* cited by examiner

*Primary Examiner* — Shane Bomar
*Assistant Examiner* — Catherine Loikith
(74) *Attorney, Agent, or Firm* — Steven Rosenblatt

(57) ABSTRACT

A modular screen system allows connection of screens using couplings that connect the annular space in each module between the screen material and the base pipe. A series of connected screens and couplings feed into a single valve to control the flow through many screens. The valve is preferably located in a coupling and the passages through the coupling or the screen can also accommodate instrumentation to detect, store or transmit well data or flows through the various screen modules.

22 Claims, 6 Drawing Sheets

MULTI-ZONE SCREEN ISOLATION SYSTEM WITH SELECTIVE CONTROL

FIELD OF THE INVENTION

The field of the invention is screen assemblies that span multiple zones and more particularly modular screen components that can be assembled with couplings where the couplings can control flow through screens in a given zone.

BACKGROUND OF THE INVENTION

In completions that span multiple zones, an array of screens is frequently positioned in each of the zones. The zones are typically isolated with packers and are individually fractured and gravel packed generally in a downhole to uphole direction. In the past a given zone could be long enough to warrant using multiple screen sections. Typically, each of these screen sections had a base pipe under the screen material and a valve, typically a sliding sleeve, associated with each screen section. The annular space between the screen material and the base pipe for each screen section was sealed at opposed ends on a given screen section and the only access into the base pipe for flow of production to the surface was the sliding sleeve valve in each of the sections.

This configuration required multiple sliding sleeve valves that had to be operated and created issues of flow distribution within a given zone. This lead to the concept of connecting the annular spaces between adjacent screens through the use of ported couplings. This, in essence, made the various standalone screens function more akin to a single screen. Several US Patents illustrate the jumper path between the annular flow areas between the screen and its respective base pipe, and they are U.S. Pat. Nos. 6,405,800 and 7,048,061. U.S. Pat. No. 6,752,207 shows a way to hook together shunt tubes outside of screen sections through couplings. U.S. Pat. Nos. 6,464,006 and 5,865,251 show gravel packing systems that use screens with sliding sleeves that can close them off, such as when a wash pipe with a shifting tool is pulled out of the screen assembly. U.S. Pat. No. 7,451,816 uses base pipe openings in screens that can be covered as an aide to gravel deposition in a surrounding annulus.

Despite the various designs that connected annular spaces in screens through jumper lines and couplings between the screen sections, the base pipes continued to hold the sliding sleeves so that there was still as many sliding sleeves to operate as before to fully open a zone. The other lingering issue of the prior designs with the location of the sliding sleeves inside the base pipe flow bore and directly under the screen assembly that covered the base pipe was that the resulting flow area or drift dimension of the screen section was diminished which limited the size of tools that could get through a given screen as well as created flow constrictions that could limit production or require the use of artificial lift techniques that consume additional power and create other costs for procurement and installation.

The present invention addresses these issues and others by placing the access valves in the couplings where there is generally more room to locate the valve structure because the outside dimension of the coupling does not have the overlying screen structure on it. Additionally a single valve can connect some to all of the screens in a given zone so as to make access to entire zone for flow or for isolation go that much faster. The equipment cost is reduced as well as the risk of a malfunction. The flow is not constricted with the valve assembly located in a coupling. The passages among the screen sections that encompass the couplings can also be the location for a variety of instruments that can sense well conditions and flow through the screen sections to name a few examples. These and other aspects of the present invention will become more apparent to those skilled in the art from a review of the description of the preferred embodiment and the associated drawings while understanding that the full scope of the invention is determined by the appended claims.

SUMMARY OF THE INVENTION

A modular screen system allows connection of screens using couplings that connect the annular space in each module between the screen material and the base pipe. A series of connected screens and couplings feed into a single valve to control the flow through many screens. The valve is preferably located in a coupling and the passages through the coupling or the screen can also accommodate instrumentation to detect, store or transmit well data or flows through the various screen modules.

DETAILED DESCRIPTION OF THE PREFERRED EMBODIMENT

Figure 1:
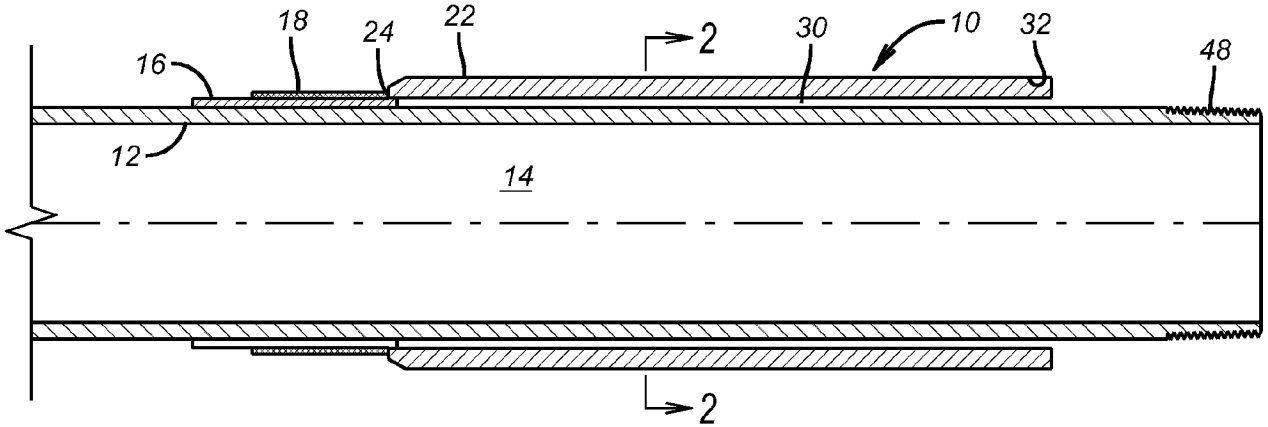
FIG. 1 is a section view of a screen module.
Figure 2:
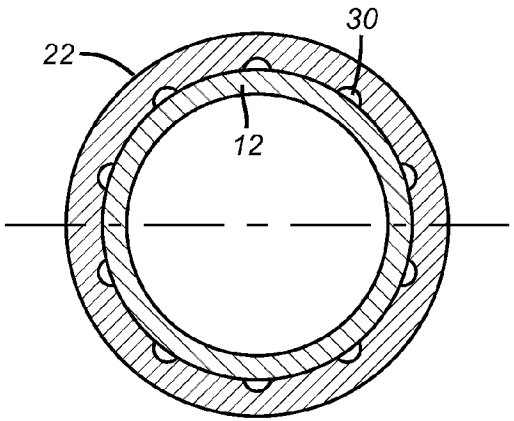
FIG. 2 is the section view through line 2-2 of FIG. 1.
Figure 3:
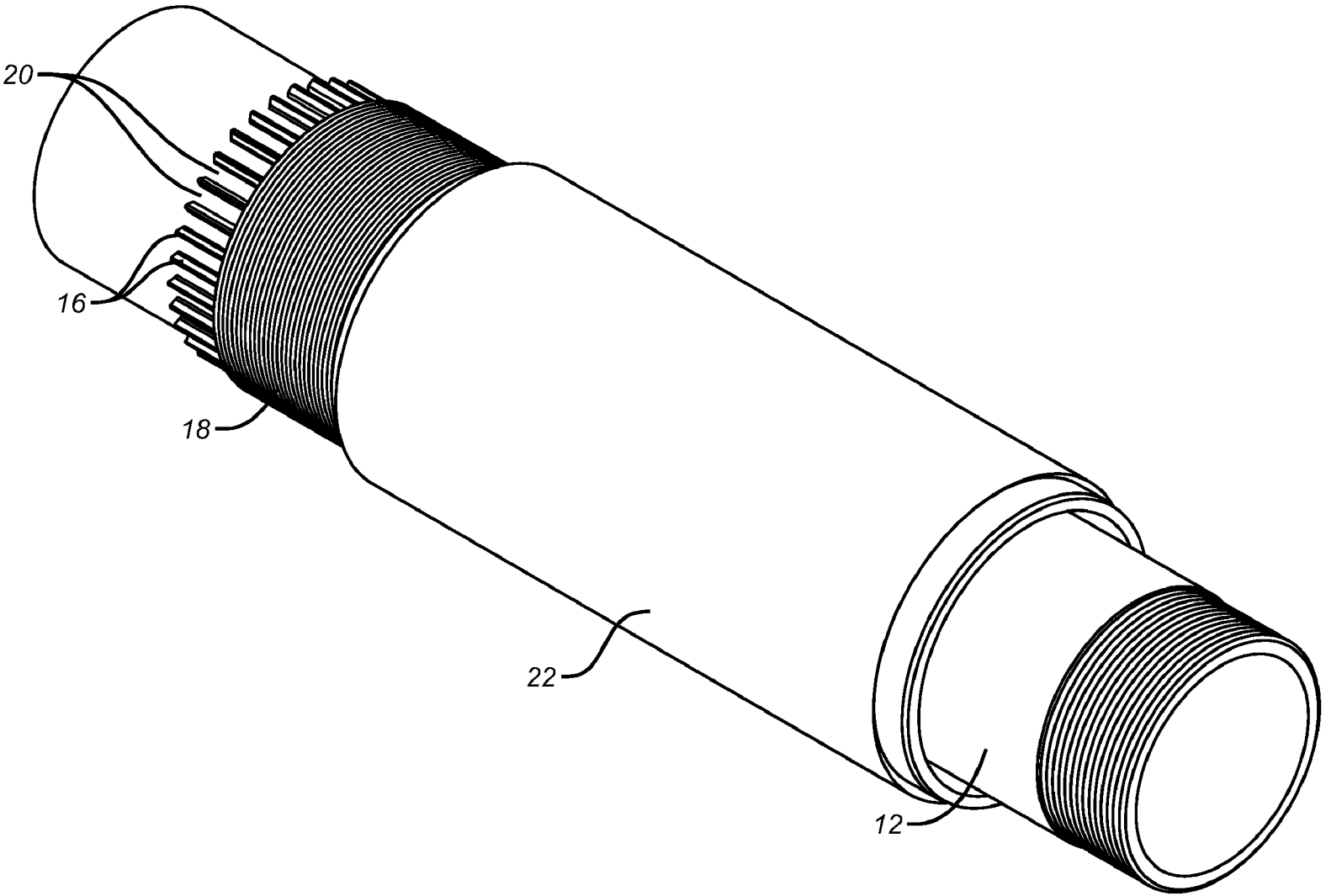
FIG. 3 is a perspective view of the screen module of FIG. 1.
Figure 8A:
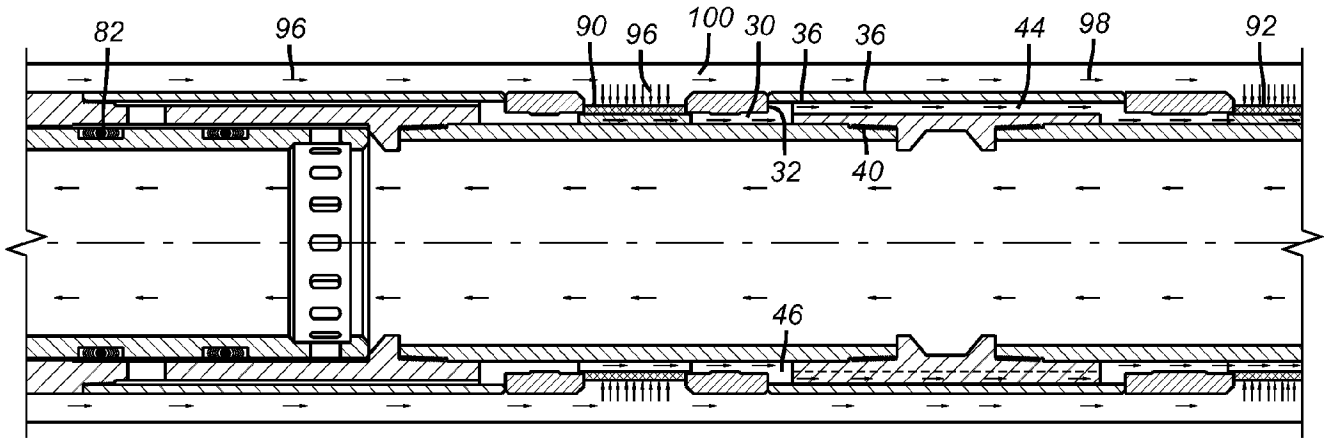
FIGS. 8*a*-8*b* are a section through an assembly of screens showing both kinds of couplings with one sliding sleeve in the closed position and another in the open position.
Figure 8B:
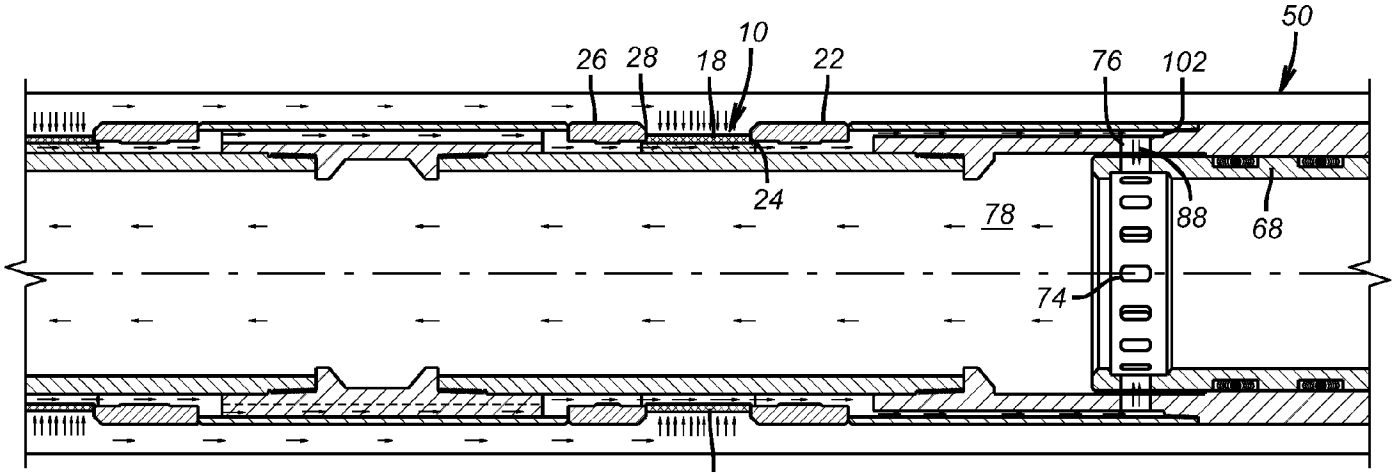

A screen module 10 is shown in FIGS. 1-3. It has a solid base pipe 12 that defines a through passage 14. A series of parallel ribs 16 retain a wire wrap screen 18 that overlays the ribs 16 creating parallel passages 20 that go under the screen 18. While one style of screen 18 is illustrated, those skilled in the art will appreciate that other types of screens can be used depending on the requirements of the specific application. For clarity, only one end ring 22 is illustrated that is welded at 24 to the right of the screen 18. FIGS. 8*a*-8*b* show a complete screen module 10 illustrating the symmetry of the structure by using end ring 26 welded at 28 to screen 18. FIG. 2 illustrates a section view through the end ring 22 showing passages 30 which preferably are in alignment with passages 20 between the rib wires 16. Passages 30 in the aggregate can have different cross sectional flow areas in different modules to serve as inflow control devices for flow balancing among modules 10. Alternatively, all modules can be identical and inflow control for flow balancing can be accomplished in other ways.

Figure 4:
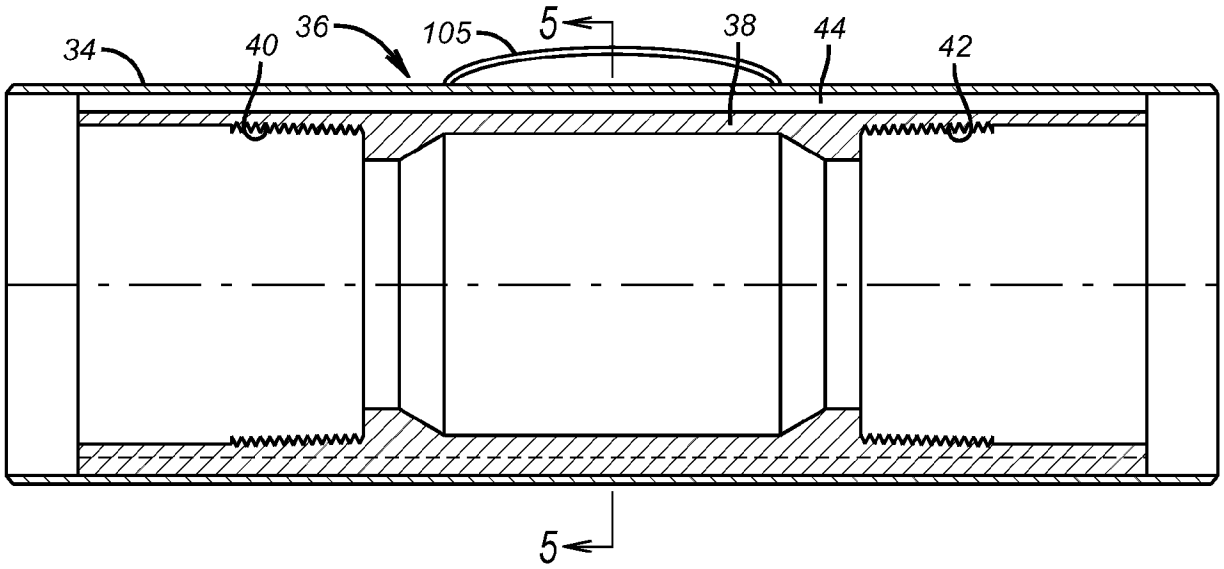
FIG. 4 is a section view of a coupling without a valve in it.
Figure 5:
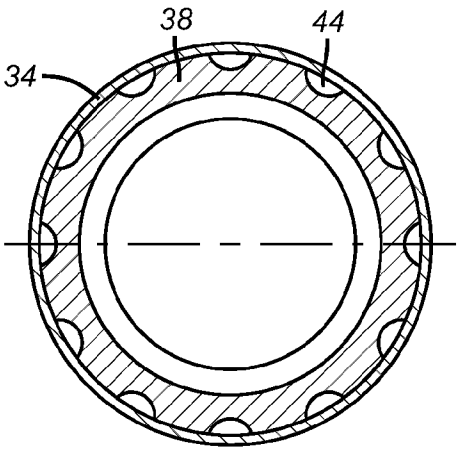
FIG. 5 is a section view along lines 5-5 of FIG. 4.

The end ring 22 has an end 32 against which abuts housing 34 of a coupling 36. The same occurs at end ring 26 but with a different coupling 36. Referring now to FIGS. 4 and 5, the coupling 36 has a body 38 that has threads 40 and 42 at opposed ends. The housing 34 has a series of passages 44 that are in flow communication with passages 30 through an annular space 46 formed when housing 34 is butted to end 32 as thread 40 is made up to thread 48 of screen module 10 shown in FIG. 1. The flow area in the aggregate between passages 30 and 44 can be in different proportions at screen modules 10 so that the flow area differences can serve as a form of inflow control device to balance flow among modules 10 in a given zone.

Figure 6:
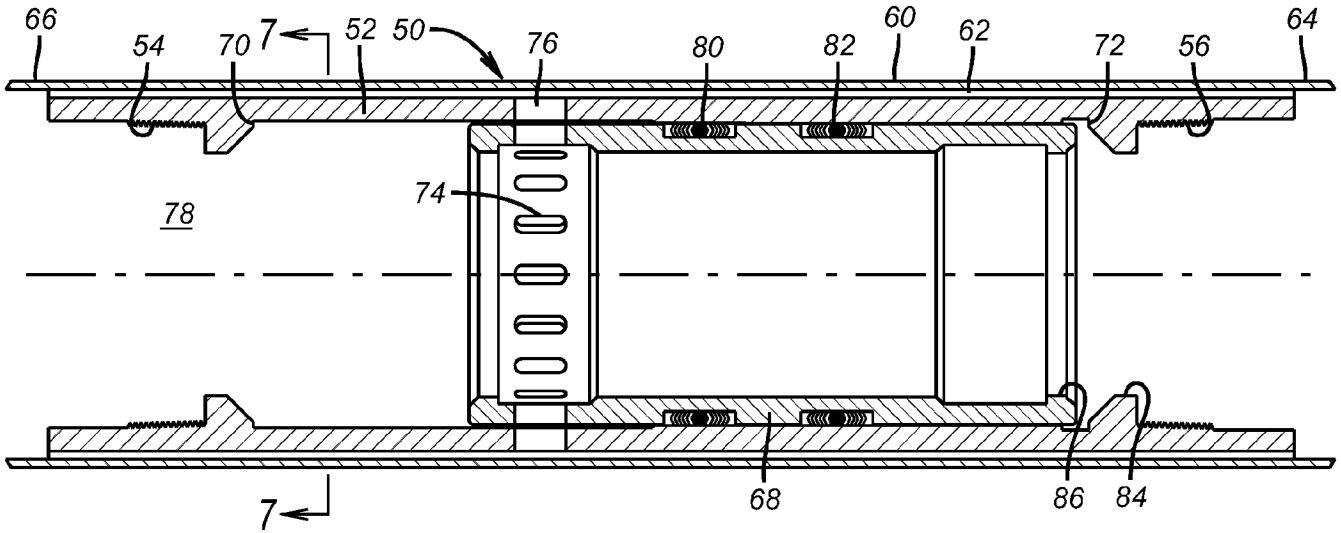
FIG. 6 is a section view of a coupling with a sliding sleeve valve in it shown in the open position.
Figure 7:
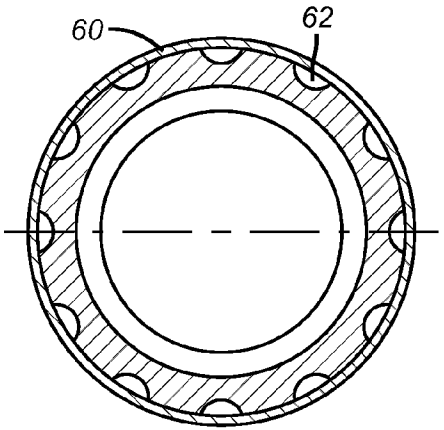
FIG. 7 is a section through line 7-7 of FIG. 6.

Another coupling type 50 is shown in FIGS. 6 and 7. It has a housing 52 and threads 54 and 56 at opposed ends. An outer housing 60 has a series of passages 62 that extend from end 64 to end 66. Passages 62 can also serve as inflow control devices for flow balancing among screen modules 10 in a given zone. A sliding sleeve 68 is positioned between shoulders 70 and 72 to define opposed travel limits. A series of openings 74 on the sliding sleeve 68 are shown aligned with openings 76 in housing 52. In this position there is flow possible between passage 62 and the main bore 78 in housing 52. Seals 80 and 82 are spaced far enough apart so that the ports 76 can be closed when the sliding sleeve 68 shifts so that seals 80 and 82 straddle the ports 76. The closed position is shown in FIG. 8*a*. Note that, as shown in FIG. 6, the drift diameter 84 is the minimum diameter through the housing 52 and that such diameter is not reduced by the inside diameter 86 of the sleeve 68.

While the valve 68 is illustrated as a sliding sleeve other variations are envisioned. The sleeve 68 can rotate to open and close ports 76. Alternatively, pressure or temperature or other types of plugs in openings 76 can be used that, for example, can be responsive to cycles of applied and removed pressure to go between open and closed positions such as in conjunction with a j-slot mechanism. Alternatively, the valve member can be responsive to production of certain fluids like water or gas to go to the closed position.

FIGS. 8*a*-8*b* show an overall system with the couplings 50 that incorporate sliding sleeves 68 at opposed ends of FIG. 8. In FIG. 8*a* the ports 76 are closed as seals 80 and 82 mounted to sliding sleeve 68 straddle opening 76. In FIG. 8*b* openings 74 and 76 are aligned so that flow represented by arrows 88 can enter the main bore 78 to get to the surface (not shown). Note that in FIGS. 8*a*-8*b* there are three screen modules 10 of the type shown in FIGS. 1-3 and they are labeled in FIGS. 8*a*-8*b* as 90, 92 and 94. Flow from the formation, represented by arrows 96 bypasses closed port 76 and can first enter screen 90. Arrows 96 and 98 illustrate the flow that started in from the annular space 100 and passed through screen 90. Annular space 100 at this time is preferably full of gravel. Note the flow indicated by arrow 98 is toward the open coupling 50 that has a sliding sleeve valve 68 in FIG. 8*b*. Inflow from screens 92 and 94 mixes with the incoming flow through screen 90 and all the flow winds up at ports 76 in FIG. 8*b* as there is a dead end 102 just beyond openings 76 in FIG. 8*b*. In the illustrated example, a single coupling 50 in FIG. 8*b* controls incoming flow from three screens 90, 92 and 94. Those skilled in the art will appreciate that any number of screens in a given isolated zone can be tied together depending on the formation pressure, the size of the flow passages between the screens, the length of a zone and the distance to the surface as well as the tubing size for the production string to the surface to mention a few of the variables. However, the illustrated system in FIGS. 8*a*-8*b* allow economy of valves as a single valve can control an entire zone of inflow that may have many modules of screen sections in it. Further, the drift 84 is not reduced or reduced less than it would have been had the sliding sleeves been aligned with a screen module 10. Because the sliding sleeves 68 are in a coupling 50 rather than in a screen module 10 the negative impact on drift is less severe or non-existent. Note also that the couplings 36 or 50 do not have any welds. This is noteworthy because such couplings are made up in the field where welding equipment and personnel who can weld may not be present. While the screen modules have welds 24 and 28 to secure the end rings 22 and 26 to the screen material 18 such welds are made in the shop where the screen modules 10 are fabricated under controlled conditions. In the field, tongs are used by rig personnel to thread the screen modules 10 together using couplings 36 or 50. Note that the outer housings 34 or 60 preferably abut at their ends to end rings on the screen modules 10. A leak tight connection is not critical as long as any gravel in the annular space 100 cannot infiltrate and bypass screening at screens such as 90, 92 and 94.

A single zone can have as few as one screen section 10 connected by a valved coupling 50 or many screen sections 10 connected by un-valved coupling 36 with one or more valved couplings 50 anywhere in the zone or either at one of the ends or anywhere in between. The objective is to link the screens 10 and produce them all from a given zone through at least one valved coupling such as 50. The zones can be isolated with a variety of packers either on opposed end or on one end if the zone goes to the hole bottom.

Figure 9:
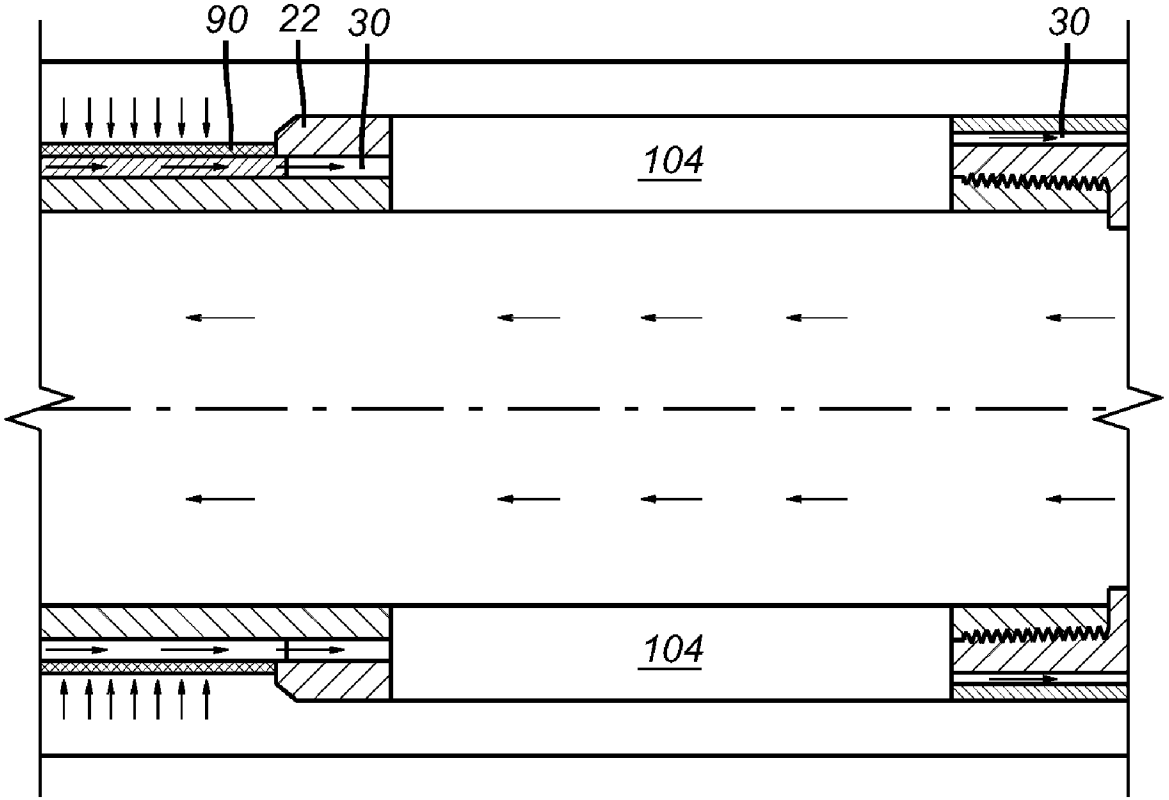
FIG. 9 is a section through a coupling showing schematically an instrument in the flow passage of the coupling that connects the annular space in adjacent screens.

FIG. 9 shows a screen such as 90 with an associated end ring 22 that defines internal passages 30. Schematically illustrated as 104 is one of many instruments that can be associated with the passage 30 for a variety of purposes such as measuring or controlling flow, pH, temperature, properties of the produced fluids such as density, viscosity or pressure to name a few. It can also be a flow control device that can be varied in conjunction with sliding sleeve position or independently of it and based on well fluid properties. This data can be logged or transmitted to the surface in real time through cables, conduits or even acoustically through the well fluids or the production sting itself. Instruments can be combined with inflow control devices for flow balancing among screen sections or combined with control devices for chemical injection stimulation. Power can be supplied to such sensors or instruments or they can be powered with locally mounted batteries. Power could be generated with some property of the flowing fluid. Other passage mounted devices can be oil and water or oil and gas separators or such passages can be incorporated into the gravel packing or fracturing operations for taking returns when depositing gravel outside screens or for delivering fracture fluids through the screens. Item 104 could be part of the base pipe or a separate module that connects the screen via a threaded connection. A centralizer 105 could be included as part or the screen module, the coupling, or as a module between them.

The sliding sleeves 68 can be operated with shifting tools on work strings, hydraulic control lines or electric motors to name a few variations. Flow in the passages that lead to openings 76 can be in one direction or two directions. Such passages can be used as return passages during gravel deposition or for fracturing.

The above description is illustrative of the preferred embodiment and many modifications may be made by those skilled in the art without departing from the invention whose scope is to be determined from the literal and equivalent scope of the claims below.

We claim:

1. A screen assembly for production from at least one subterranean zone, comprising:

at least one screen module comprising a base pipe and a filtering assembly mounted over said base pipe to define at least one screen flow path therebetween, said filtering assembly having opposed ends extending between end connections of said base pipe;

at least one coupling connected to said screen module at one of said end connections and further comprising at least one coupling flow path in flow communication with said screen flow path when said coupling is assembled to said screen module, said coupling defines an extension of said screen flow path in said filtering assembly;

said base pipe and coupling, when assembled also comprising a production flow path from the subterranean zone discrete from said coupling and screen flow paths; and a valve assembly in said coupling to provide selective access between said coupling flow path and said production flow path.

2. The assembly of claim 1, wherein:

said production flow path comprises a drift diameter and said valve assembly comprises a valve member which does not reduce said drift diameter.

3. The assembly of claim 1, wherein:

said coupling comprises an internal coupling housing and a surrounding outer coupling housing, said internal coupling housing secured to said base pipe by threading which threading puts said outer or internal coupling housing in contact with said filtering assembly for an extension of said screen flow path in said filtering assembly.

4. The assembly of claim 3, wherein:

said outer coupling housing comprises a plurality of grooves facing said internal coupling housing to define said coupling flow paths.

5. The assembly of claim 1, wherein:

said base pipe has no openings directly to said production flow path but is indirectly connected to said production flow path only through said flow opening at said valve assembly.

6. The assembly of claim 1, further comprising:

at least one instrument or control device in said screen flow path or said coupling flow path to measure a condition in the zone or regulate flow in said zone.

7. The assembly of claim 1, wherein:

said valve assembly comprises a valve member selectively movable to align or misalign at least one port in said coupling with said production flow path.

8. The assembly of claim 7, wherein:

said valve member comprises a sleeve with ports straddled by seals that engage said production flow path where said sleeve shifts or turns.

9. The assembly of claim 8, wherein:

said production flow path has a drift diameter and said sliding sleeve does not reduce said drift diameter.

10. The assembly of claim 1, wherein:

said screen or coupling flow paths have different cross sectional flow areas to balance flow between or among screen modules in a zone.

11. The assembly of claim 1, wherein:

said coupling further comprises a centralizer.

12. A screen assembly for production from at least one subterranean zone, comprising:

at least one screen module comprising a base pipe and a filtering assembly mounted over said base pipe to define at least one screen flow path therebetween;

at least one coupling connected to said screen module and further comprising at least one coupling flow path in flow communication with said screen flow path when said coupling is assembled to said screen module;

said base pipe and coupling, when assembled also comprising a production flow path from the subterranean zone discrete from said coupling and screen flow paths; and a valve assembly in said coupling to provide selective access between said coupling flow path and said production flow path;

said coupling comprises an internal coupling housing and a surrounding outer coupling housing, said internal coupling housing secured to said base pipe by threading which threading puts said outer or internal coupling housing in contact with said filtering assembly;

said filtering assembly comprises a screen supported at a spaced relation to said base pipe and opposed end rings secured to said screen with grooves in said rings facing said base pipe to define part of said screen flow path.

13. The assembly of claim 12, wherein:

said outer or internal coupling housing abutting said end ring when said coupling is threaded to said base pipe.

14. The assembly of claim 13, wherein:

said outer coupling housing when abutting said end ring does not overlap said end ring.

15. The assembly of claim 14, wherein:

said outer coupling housing when abutting said end ring is not welded to said end ring.

16. The assembly of claim 12, wherein:

said screen comprises a plurality of axially oriented rib wires on said base pipe supporting a wire wrap that serves as said screen, said ribs defining screen flow paths under said wire wrap that continue in said end rings.

17. The assembly of claim 16, wherein:

said end rings are seal welded to said wire wrap.

18. A screen assembly for production from at least one subterranean zone, comprising:

at least one screen module comprising a base pipe and a filtering assembly mounted over said base pipe to define at least one screen flow path therebetween;

at least one coupling connected to said screen module and further comprising at least one coupling flow path in flow communication with said screen flow path when said coupling is assembled to said screen module;

said base pipe and coupling, when assembled also comprising a production flow path from the subterranean zone discrete from said coupling and screen flow paths; and a valve assembly in said coupling to provide selective access between said coupling flow path and said production flow path;

said base pipe has no openings directly to said production flow path but is indirectly connected to said production flow path only through said flow opening at said valve assembly;

said at least one coupling comprises a plurality of couplings without a valve assembly connecting a plurality of screen modules without access to said production flow path and at least one coupling comprising said valve assembly to provide access through said at least one valve assembly for multiple said screen assemblies in a zone to said production flow path.

19. A screen assembly for production from at least one subterranean zone, comprising:

at least one screen module comprising a base pipe and a filtering assembly mounted over said base pipe to define at least one screen flow path therebetween;

at least one coupling connected to said screen module and further comprising at least one coupling flow path in flow communication with said screen flow path when said coupling is assembled to said screen module;

said base pipe and coupling, when assembled also comprising a production flow path from the subterranean zone discrete from said coupling and screen flow paths; and a valve assembly in said coupling to provide selective access between said coupling flow path and said production flow path;

said coupling comprises an internal coupling housing and a surrounding outer coupling housing, said internal coupling housing secured to said base pipe by threading which threading puts said outer or internal coupling housing in contact with said filtering assembly;

said outer coupling housing comprises a plurality of grooves facing said internal coupling housing to define said coupling flow paths;

said filtering assembly comprises a screen supported at a spaced relation to said base pipe and opposed end rings secured to said screen with grooves in said rings facing said base pipe to define part of said screen flow path.

20. The assembly of claim 19, wherein:

said outer or inner coupling housing and an end ring, when abutting, defining an annular space between said axial grooves in said outer coupling housing and in said end ring so that fluid communication is maintained through said annular space regardless of the circumferential relative position of said grooves on opposed sides of said annular space.

21. A screen assembly for production from at least one subterranean zone, comprising:

at least one screen module comprising a base pipe and a filtering assembly mounted over said base pipe to define at least one screen flow path therebetween;

at least one coupling connected to said screen module and further comprising at least one coupling flow path in flow communication with said screen flow path when said coupling is assembled to said screen module;

said base pipe and coupling, when assembled also comprising a production flow path from the subterranean zone discrete from said coupling and screen flow paths; and a valve assembly in said coupling to provide selective access between said coupling flow path and said production flow path;

said filtering assembly comprises a screen supported at a spaced relation to said base pipe and opposed end rings secured to said screen with at least one passage in said rings to define part of said screen flow path.

22. The screen assembly of claim 21, wherein:

said passage in said opposed end rings comprises grooves in said rings facing said base pipe to define part of said screen flow path.

* * * * *